US009959969B2

(12) United States Patent
Nagai et al.

(10) Patent No.: US 9,959,969 B2
(45) **Date of Patent: *May 1, 2018**

(54) MULTILAYER COIL COMPONENT

(71) Applicant: TDK CORPORATION, Tokyo (JP)

(72) Inventors: Yuusuke Nagai, Tokyo (JP); Kunihiko Kawasaki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/275,832

(22) Filed: Sep. 26, 2016

(65) Prior Publication Data

US 2017/0103845 A1 Apr. 13, 2017

(30) Foreign Application Priority Data

Oct. 8, 2015 (JP) ..... 2015-200247

(51) Int. Cl.

| | |
|---|---|
| ***H01F 5/00*** | (2006.01) |
| ***H01F 27/28*** | (2006.01) |
| ***H01F 3/14*** | (2006.01) |
| ***H01F 17/00*** | (2006.01) |
| ***H01F 17/04*** | (2006.01) |
| *H01F 27/255* | (2006.01) |

(52) U.S. Cl.

CPC ..... *H01F 27/2804* (2013.01); *H01F 3/14* (2013.01); *H01F 5/00* (2013.01); *H01F 17/0013* (2013.01); *H01F 17/04* (2013.01); *H01F 27/255* (2013.01); *H01F 2027/2809* (2013.01)

(58) Field of Classification Search

CPC ..... H01F 5/00; H01F 27/00–27/36
USPC ..... 336/65, 83, 200, 232–234
See application file for complete search history.

(56) References Cited

U.S. PATENT DOCUMENTS

| | | | | |
|---|---|---|---|---|
| 2006/0152325 | A1* | 7/2006 | Nakao | H01F 17/0013 336/223 |
| 2013/0027171 | A1* | 1/2013 | Ito | H01F 17/0013 336/200 |
| 2014/0247102 | A1* | 9/2014 | Kurobe | H01F 5/003 336/200 |

FOREIGN PATENT DOCUMENTS

JP 2010-192715 A 9/2010

* cited by examiner

*Primary Examiner* — Tuyen Nguyen
(74) *Attorney, Agent, or Firm* — Oliff PLC

(57) ABSTRACT

Each of internal conductors includes an annular portion with two end portions and an extension portion extending along the one end portion from the other end portion and separated from the one end portion. An edge of the one end portion and an edge of the other end portion oppose each other. The internal conductors include two first internal conductors and a second internal conductor located between the first internal conductors in a first direction. The one end portion of at least one first internal conductor includes a first portion overlapping the edges of the two end portions of the second internal conductor and a second portion overlapping a region between the edges of the two end portions of the second internal conductor, when viewed from the first direction. The second portion is recessed at a side opposite to the region, as compared with the first portion.

6 Claims, 10 Drawing Sheets

MULTILAYER COIL COMPONENT

TECHNICAL FIELD

The present invention relates to a multilayer coil component.

BACKGROUND

Japanese Unexamined Patent Publication No, 2010-192715 discloses a multilayer coil component that includes an element body having magnetism and a coil including a plurality of internal conductors disposed in the element body. Each of the internal conductors includes an annular portion that includes one end portion and another end portion and an extension portion that extends along the one end portion from the other end portion and is separated from the one end portion. An edge of the one end portion and an edge of the other end portion oppose each other. The plurality of internal conductors include at least two first internal conductors and a second internal conductor located between the two first internal conductors in a first direction.

SUMMARY

In the multilayer coil component, a distance between the edges of the one end portion and the other end portion of the annular portion of the second internal conductor is small. For this reason, a region between the first internal conductors adjacent to each other in the first direction is narrow between the edges of the one end portion and the other end portion of the second internal conductor. A magnetic material to configure the element body is not sufficiently filled into the region. For this reason, the density of the region is low and the strength of the region is not sufficient. As a result, a crack may be generated in the region.

An object of one aspect of the present invention is to provide a multilayer coil component in which generation of a crack is suppressed.

A multilayer coil component according to one aspect of the present invention includes an element body having magnetism and a coil. The coil includes a plurality of internal conductors disposed in the element body. Each of the plurality of internal conductors includes an annular portion with one end portion and another end portion and an extension portion. The extension portion extends along the one end portion from the other end portion and is separated from the one end portion. An edge of the one end portion and an edge of the other end portion oppose each other. The plurality of internal conductors include two first internal conductors and a second internal conductor located between the two first internal conductors in a first direction. The one end portion of at least one first internal conductor of the two first internal conductors includes a first portion overlapping the edges of the one end portion and the other end portion of the second internal conductor and a second portion overlapping a first region between the edges of the one end portion and the other end portion of the second internal conductor, when viewed from the first direction. The second portion is recessed at a side opposite to the first region, as compared with the first portion.

In the multilayer coil component according to the one aspect, the first portion of at least one first internal conductor overlaps the edges of the second internal conductor. The second portion of at least one first internal conductor overlaps the first region. The second portion of the at least one first internal conductor and the other first internal conductor are adjacent to each other in the first direction with the first region therebetween, between the edges of the second internal conductor. That is, a region between the first internal conductors adjacent to each other in the first direction exists between the edges of the second internal conductor. The second portion is recessed at the side opposite to the first region, as compared with the first portion. For this reason, the region between the first internal conductors adjacent to each other in the first direction is wide in the first direction and a volume of the region is large. As a result, because the strength in the region between the first internal conductors adjacent to each other in the first direction is improved, generation of a crack is suppressed in the first region.

In the multilayer coil component according to the one aspect, a thickness of the second portion in the first direction may be smaller than a thickness of the first portion in the first direction. In this case, because the second portion of the first internal conductor is thinner than the first portion of the first internal conductor in the first direction, the region between the first internal conductors adjacent to each other in the first direction is surely widened in the first direction and the volume of the region is surely increased. As a result, because the strength in the region between the first internal conductors adjacent to each other in the first direction is surely improved, generation of the crack is surely suppressed in the first region.

In the multilayer coil component according to the one aspect, the plurality of internal conductors may further include another second internal conductor. In this case, the first internal conductor may be located between the second internal conductor and the other second internal conductor in the first direction. The one end portion of at least one second internal conductor of the second internal conductor and the other second internal conductor may include a third portion overlapping the edges of the one end portion and the other end portion of the first internal conductor and a fourth portion overlapping a second region between the edges of the one end portion and the other end portion of the first internal conductor, when viewed from the first direction. The fourth portion may be recessed at a side opposite to the second region, as compared with the third portion. In the multilayer coil component of this embodiment, the third portion of at least one second internal conductor overlaps the edges of the first internal conductor. The fourth portion of at least one second internal conductor overlaps the second region. Between the edges of the first internal conductor, the fourth portion of at least one second internal conductor and another second internal conductor are adjacent to each other in the first direction with the second region therebetween. That is, a region between the second internal conductors adjacent to each other in the first direction exists between the edges of the first internal conductor. The fourth portion is recessed at the side opposite to the second region, as compared with the third portion. For this reason, the region between the second internal conductors adjacent to each other in the first direction is wide in the first direction and a volume of the region is large. As a result, because the strength in the region between the second internal conductors adjacent to each other in the first direction is improved, generation of the crack is suppressed in the second region.

In the multilayer coil component according to the one aspect, a thickness of the fourth portion in the first direction may be smaller than a thickness of the third portion in the first direction. In this case, because the fourth portion of the second internal conductor is thinner than the third portion of the second internal conductor in the first direction, the region between the second internal conductors adjacent to each other in the first direction is surely widened in the first direction and the volume of the region is surely increased. As a result, because the strength in the region between the second internal conductors adjacent to each other in the first direction is surely improved, generation of the crack is surely suppressed in the second region.

The multilayer coil component according to the one aspect may further include a low-permeability layer that has permeability lower than permeability of the element body. In this case, the plurality of internal conductors may include conductor portions overlapping each other when viewed from the first direction. The low-permeability layer may contact the conductor portions, between the internal conductors adjacent to each other in the first direction. In the multilayer coil component of this embodiment, the low-permeability layer contact the conductor portions, between the internal conductors adjacent to each other in the first direction. For this reason, magnetic flux generated around the individual internal conductors in the element body is blocked by the low-permeability layer. As a result, generation of magnetic saturation is suppressed and a direct-current superposition characteristic is improved.

In the multilayer coil component according to the one aspect, the low-permeability layer may include a fifth portion contacting the internal conductor adjacent to the low-permeability layer in the first direction and a sixth portion separated from the internal conductor adjacent to the low-permeability layer in the first direction, in the first direction. In this case, the element body may include element body regions interposed between the sixth portion and the internal conductors. In the multilayer coil component of this embodiment, the direct-current superposition characteristic is improved and generation of the crack is suppressed.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION

Figure 1:
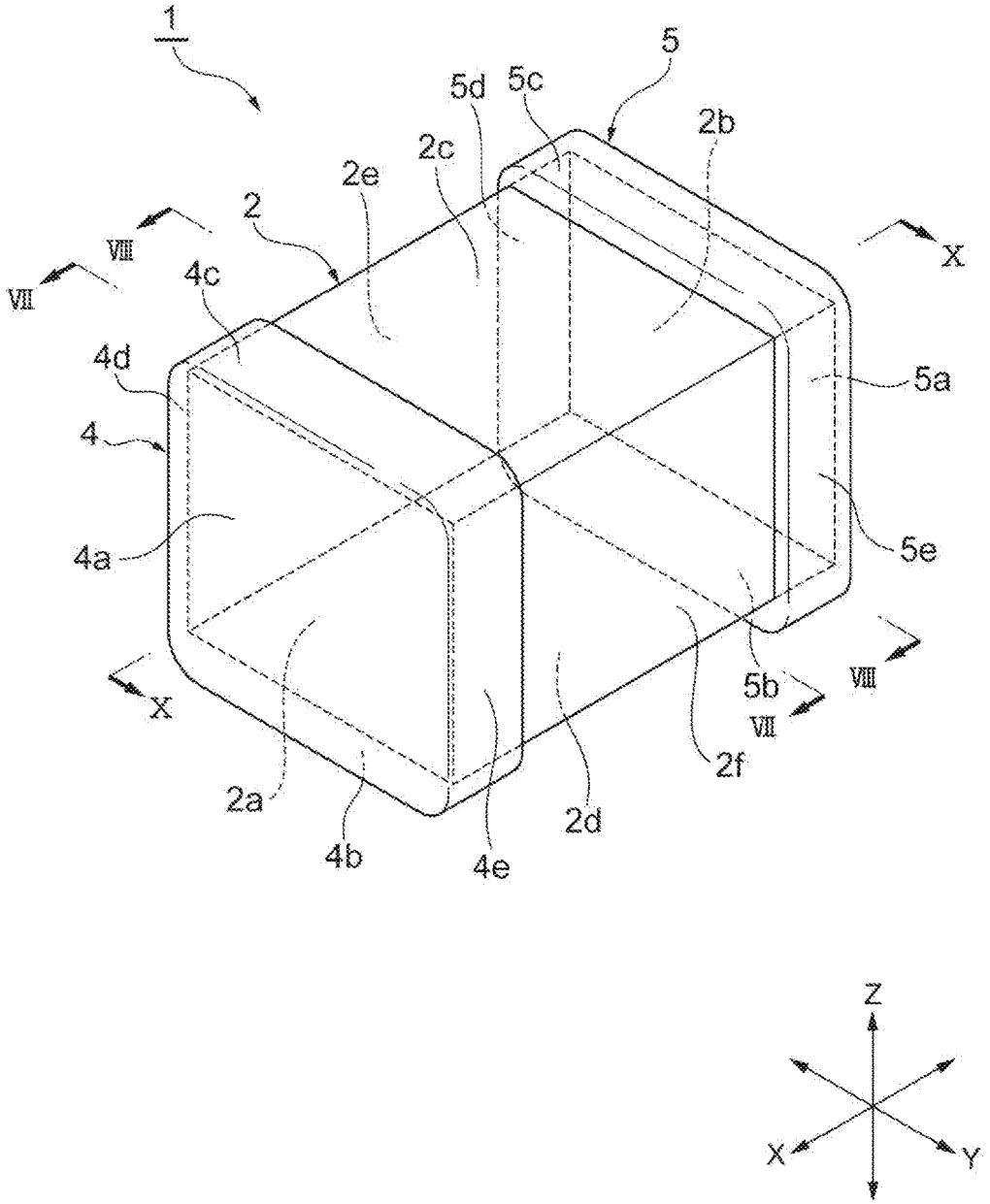
FIG. 1 is a perspective view illustrating a multilayer coil component according to a first embodiment.

Hereinafter, an embodiment of the present invention will be described in detail with reference to the attached drawings. In the following description, the same elements or elements having the same function are assigned the same reference numeral, and the redundant description will be omitted.

First Embodiment

Figure 2:
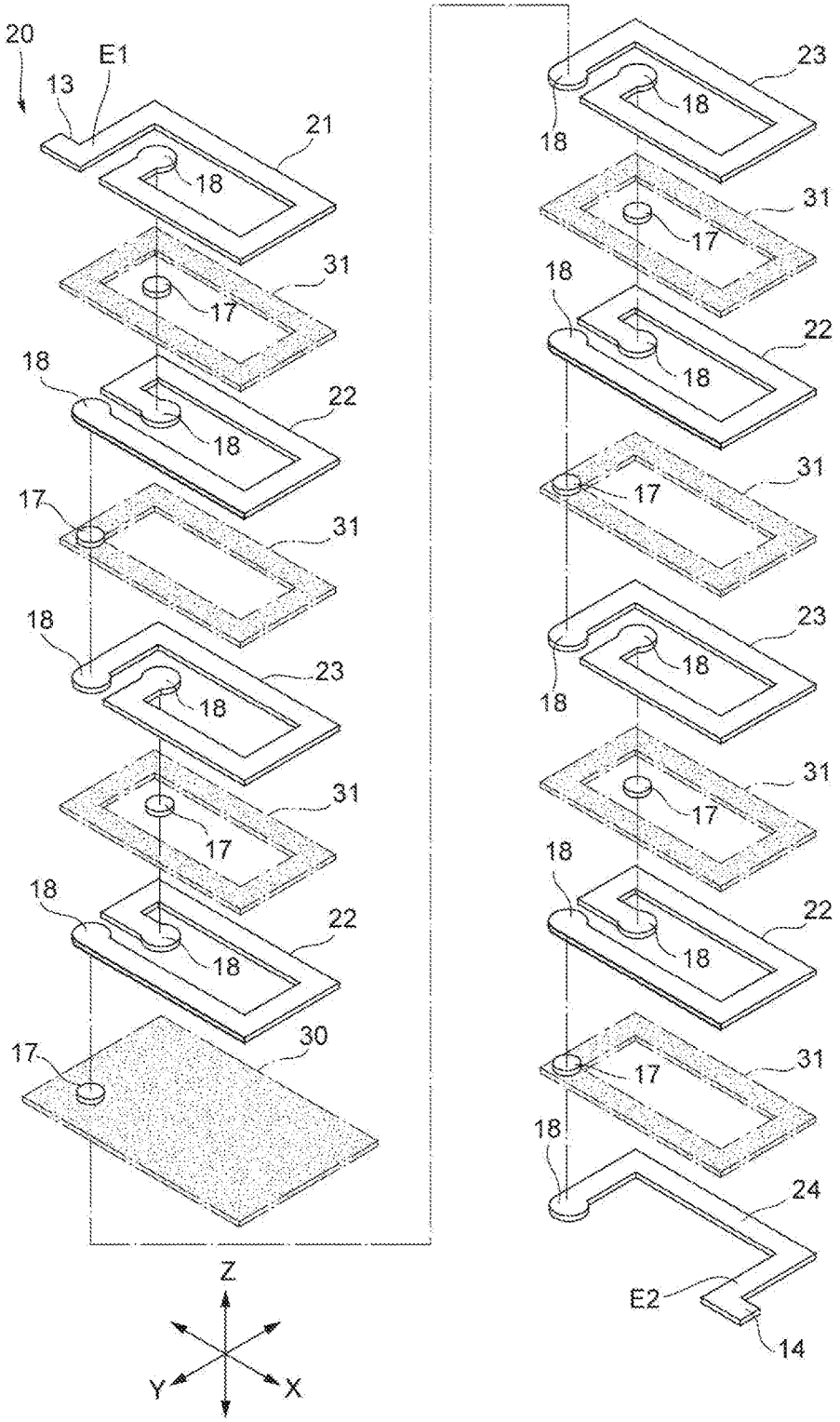
FIG. 2 is an exploded perspective view of the multilayer coil component illustrated in FIG. 1.
Figure 6:
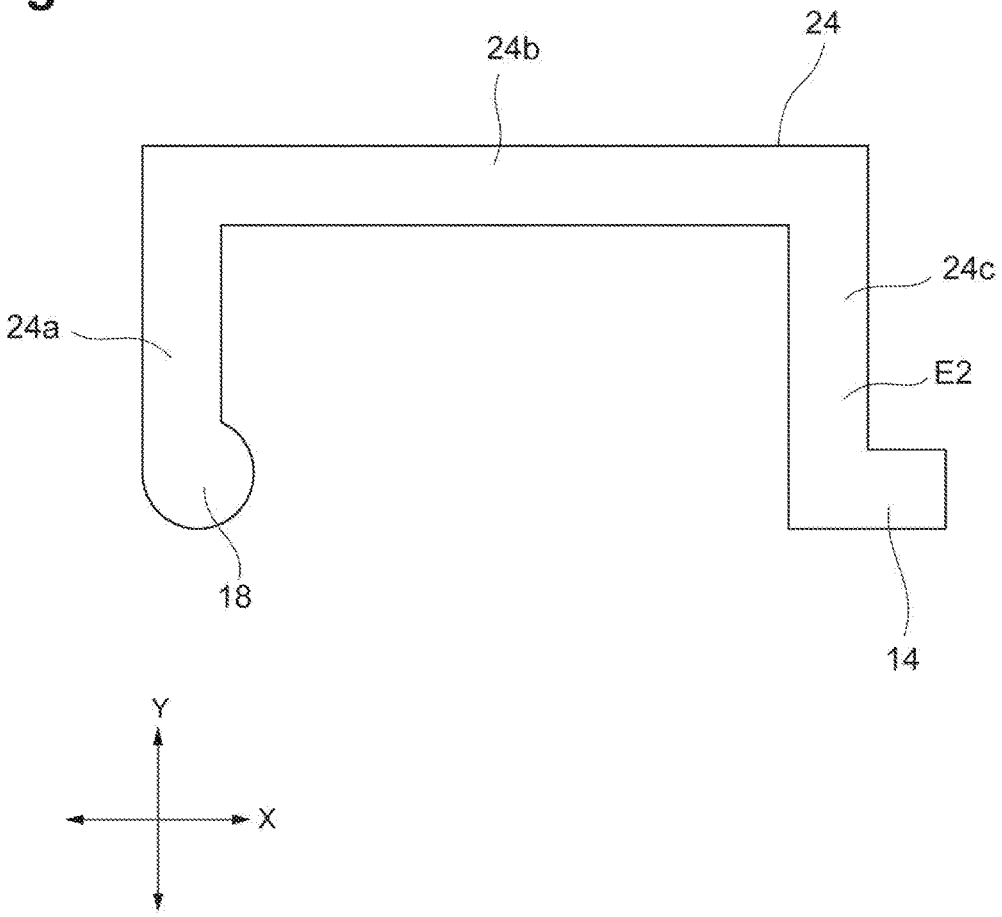
FIG. 6 is a plan view illustrating a coil conductor illustrated in FIG. 2.
Figure 7:
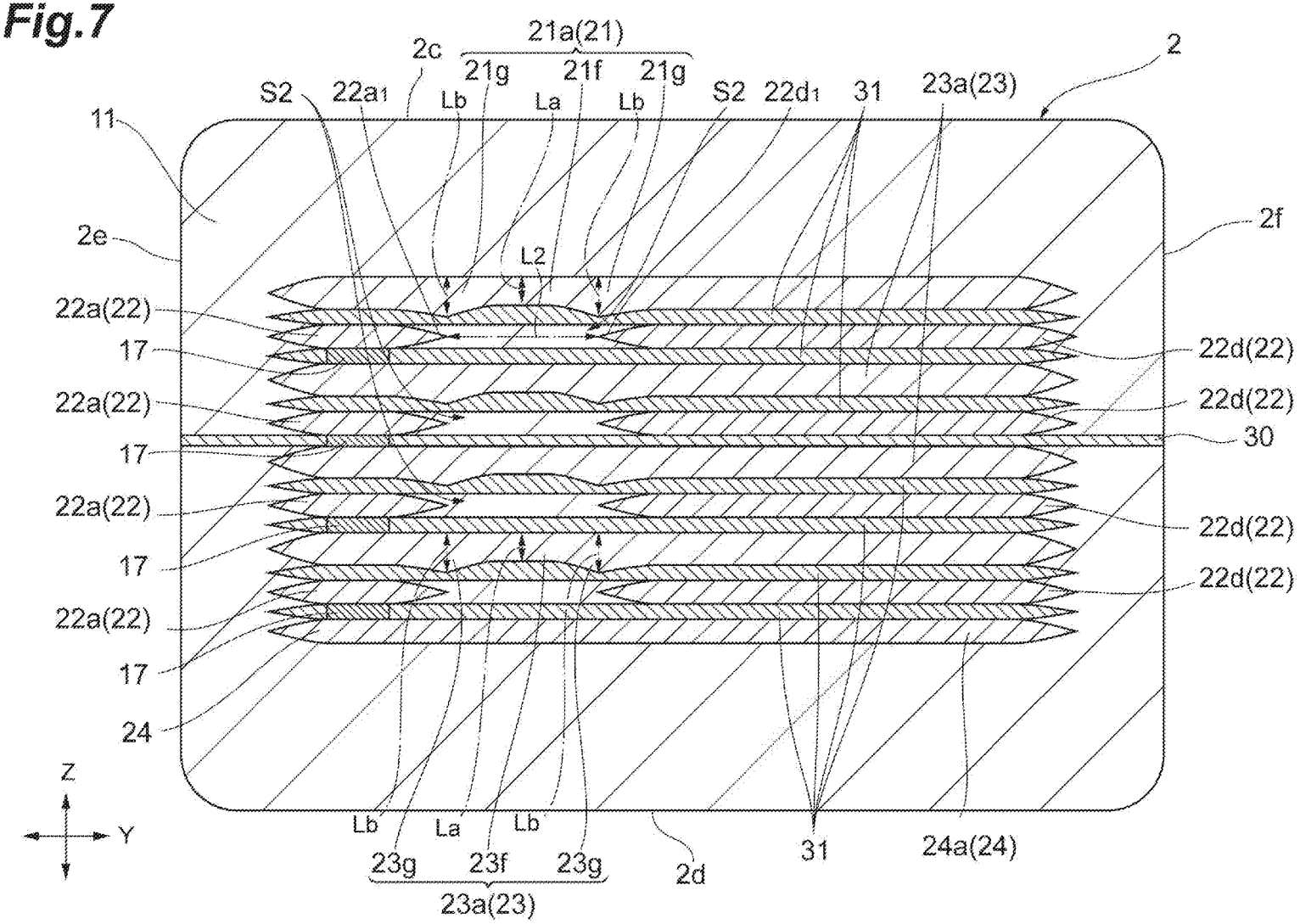
FIG. 7 is a cross-sectional view of an element body taken along the line VII to VII of FIG. 1.
Figure 8:
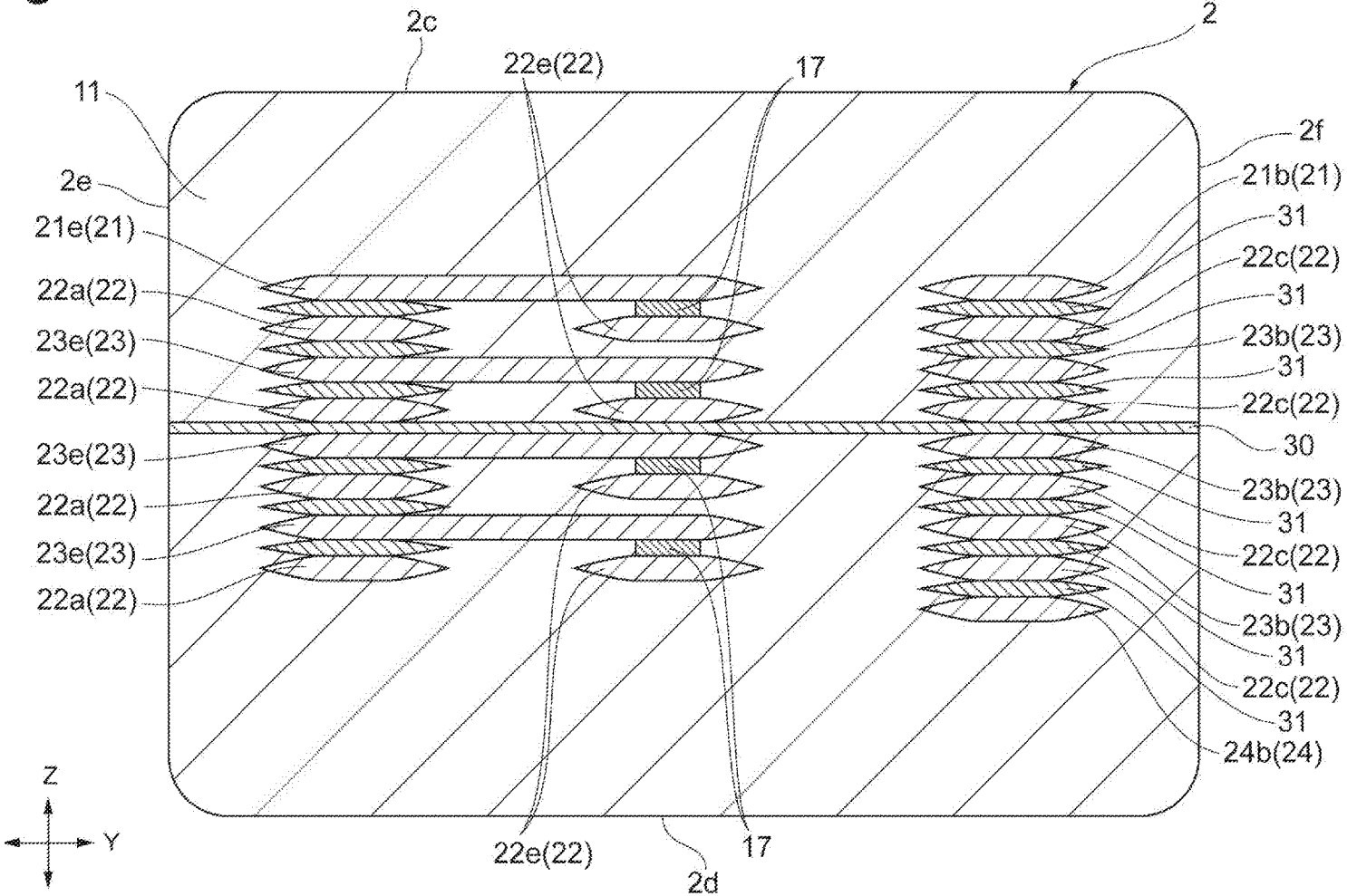
FIG. 8 is a cross-sectional view of the element body taken along the line VIII to VIII of FIG. 1.

A configuration of a multilayer coil component according to a first embodiment will be described with reference to FIGS. 1 to 8. FIG. 1 is a perspective view illustrating the multilayer coil component according to the first embodiment. FIG. 2 is an exploded perspective view of the multilayer coil component illustrated in FIG. 1. FIGS. 3 to 6 are plan views illustrating coil conductors illustrated in FIG. 2. FIG. 7 is a cross-sectional view of an element body taken along the line VII to VII of FIG. 1. FIG. 8 is a cross-sectional view of the element body taken along the line VIII to VIII of FIG. 1. In FIG. 2, illustration of a magnetic portion and external electrodes is omitted. In FIGS. 7 and 8, illustration of the external electrodes is omitted.

As illustrated in FIG. 1, a multilayer coil component 1 includes an element body 2 and a pair of external electrodes 4 and 5. The external electrodes 4 and 5 are disposed on both end portions of the element body 2.

The element body 2 has a rectangular parallelepiped shape. The element body 2 includes a pair of end surfaces 2*a* and 2*b* opposing each other and four side surfaces 2*c*, 2*d*, 2*e*, and 2*f*, as external surfaces thereof. The four side surfaces 2*c*, 2*d*, 2*e*, and 2*f* extend in a direction in which the end surface 2*a* and the end surface 2*b* oppose each other, to connect the pair of end surfaces 2*a* and 2*b*. The side surface 2*d* is a surface opposing an electronic apparatus (for example, a circuit board or an electronic component) not illustrated in the drawings, when the multilayer coil component 1 is mounted on the electronic apparatus.

A direction (X direction in the drawings) in which the end surface 2*a* and the end surface 2*b* oppose each other, a direction (Z direction in the drawings) in which the side surface 2*c* and the side surface 2*d* oppose each other, and a direction (Y direction in the drawings) in which the side surface 2*e* and the side surface 2*f* oppose each other are approximately orthogonal to each other. The rectangular parallelepiped shape includes a shape of a rectangular parallelepiped with chamfered corner portions and ridge portions, and a shape of a rectangular parallelepiped with rounded corner portions and ridge portions.

Figure 3:
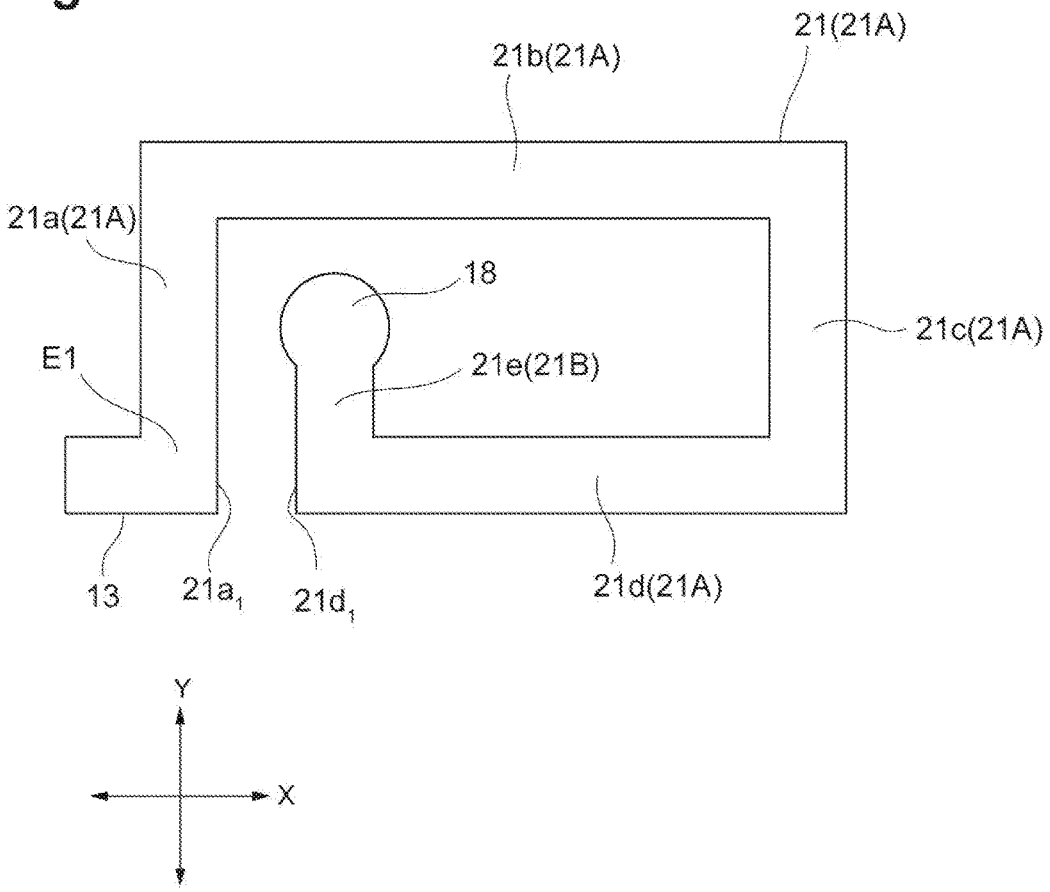
FIG. 3 is a plan view illustrating a coil conductor illustrated in FIG. 2.

The element body 2 is configured by laminating a plurality of magnetic layers and includes a magnetic portion 11 (refer to FIG. 3). The plurality of magnetic layers are laminated in the direction in which the side surface 2*c* and the side surface 2*d* oppose each other, That is, a direction in which the plurality of magnetic layers are laminated coincides with the direction (Z direction in the drawings) in which the side surface 2*c* and the side surface 2*d* oppose each other. Hereinafter, the direction in which the plurality of magnetic layers are laminated (that is, the direction in which the side surface 2*c* and the side surface 2*d* oppose each other) is called the "Z direction". Each of the plurality of magnetic layers has an approximately rectangular shape. In the actual element body 2, the plurality of magnetic layers is integrated in such a manner that inter-layer boundaries cannot be visualized.

The magnetic portion 11 is configured as a sintered body of magnetic paste including powder of a magnetic material (a Ni—Cu—Zn based ferrite material, a Ni—Cu—Zn—Mg based ferrite material, or a Ni—Cu based ferrite material), for example. That is, the element body 2 has magnetism. The magnetic paste may include powder such as a Fe alloy.

The external electrode 4 is disposed on the end surface 2*a* of the element body 2 and the external electrode 5 is disposed on the end surface 2*b* of the element body 2. That is, the external electrode 4 and the external electrode 5 are separated from each other in the direction in which the end surface 2*a* and the end surface 2*b* oppose each other. Each of the external electrodes 4 and 5 has an approximately rectangular shape in planar view and corners of the external electrodes 4 and 5 are rounded. The external electrodes 4 and 5 include a conductive material (for example, Ag or Pd). The external electrodes 4 and 5 are configured as sintered bodies of conductive paste including conductive metal powder (for example, Ag powder or Pd powder) and glass frit. Plating layer is formed on surfaces of the external electrodes 4 and 5 by electroplating. For example, the electroplating to be used is Ni plating and Sn plating.

The external electrode 4 includes five electrode portions of an electrode portion 4*a* located on the end surface 2*a*, an electrode portion 4*b* located on the side surface 2*d*, an electrode portion 4*c* located on the side surface 2*c*, an electrode portion 4*d* located on the side surface 2*e*, and an electrode portion 4*e* located on the side surface 2*f*. The electrode portion 4*a* covers an entire surface of the end surface 2*a*. The electrode portion 4*b* covers a part of the side surface 2*d*. The electrode portion 4*c* covers a part of the side surface 2*c*. The electrode portion 4*d* covers a part of the side surface 2*e*. The electrode portion 4*e* covers a part of the side surface 2*f*. The five electrode portions 4*a*, 4*b*, 4*c*, 4*d*, and 4*e* are integrally formed.

The external electrode 5 includes five electrode portions of an electrode portion 5*a* located on the end surface 2*b*, an electrode portion 5*b* located on the side surface 2*d*, an electrode portion 5*c* located on the side surface 2*c*, an electrode portion 5*d* located on the side surface 2*e*, and an electrode portion 5*e* located on the side surface 2*f*. The electrode portion 5*a* covers an entire surface of the end surface 2*b*. The electrode portion 5*b* covers a part of the side surface 2*d*. The electrode portion 5*c* covers a part of the side surface 2*c*. The electrode portion 5*d* covers a part of the side surface 2*e*. The electrode portion 5*e* covers a part of the side surface 2*f*. The five electrode portions 5*a*, 5*b*, 5*c*, 5*d*, and 5*e* are integrally formed.

As illustrated in FIG. 2, the multilayer coil component 1 includes a plurality of coil conductors 21, 22, 23, and 24, lead conductors 13 and 14, one magnetic gap layer 30, and a plurality of low-permeability layers 31, which are provided in the element body 2. In FIG. 2, the magnetic gap layer 30 and the individual low-permeability layers 31 are shown by dashed-dotted lines.

The coil conductors 21 to 24 include conductor portions that are separated from each other in the Z direction (first direction) and overlap each other when viewed from the Z direction. Ends of the coil conductors 21 to 24 are connected to each other by through-hole conductors 17. The through-hole conductors 17 are located between the ends adjacent to each other in the Z direction. Each of the coil conductors 21 to 24 includes a connection portion 18 to which the through-hole conductor 17 is connected. The connection portions 18 of the coil conductors 21 to 24 are connected to each other via the through-hole conductors 17, so that the coil conductors 21 to 24 are electrically connected to each other. As a result, a coil 20 including the coil conductors 21 to 24 is configured in the element body 2. That is, the multilayer coil component 1 includes the coil 20 in the element body 2. An axial direction of the coil 20 is the Z direction.

The coil conductor 21 is disposed at a position closest to the side surface 2*c* of the element body 2 in the lamination direction among the plurality of coil conductors 21 to 24. In this embodiment, a conductor pattern of the coil conductor 21 and a conductor pattern of the lead conductor 13 are formed to be integrally connected. The lead conductor 13 connects a connection portion E1 of the coil conductor 21 and the external electrode 4 and is exposed to the end surface 2*a* of the element body 2. The lead conductor 13 is connected to the electrode portion 4*a* covering the end surface 2*a*. One end portion of the coil 20 and the external electrode 4 are electrically connected via the lead conductor 13.

The coil conductor 24 is disposed at a position closest to the side surface 2*d* of the element body 2 in the lamination direction among the plurality of coil conductors 21 to 24. In this embodiment, a conductor pattern of the coil conductor 24 and a conductor pattern of the lead conductor 14 are formed to be integrally connected. The lead conductor 14 connects a connection portion E2 of the coil conductor 24 and the external electrode 5 and is exposed to the end surface 2*b* of the element body 2. The lead conductor 14 is connected to the electrode portion 5*a* covering the end surface 2*b*. Another end portion of the coil 20 and the external electrode 5 are electrically connected via the lead conductor 14.

The coil conductor 22 is disposed between the coil conductor 21 and the coil conductor 23, and the coil conductor 22 is disposed between the coil conductors 23. That is, the plurality of coil conductors 22 and the plurality of coil conductors 23 are alternately arranged between the coil conductor 21 and the coil conductor 24. The plurality of coil conductors 22 are arranged in the first direction (Z direction) to sandwich the coil conductor 23 between the coil conductors 22. That is, the coil conductor 23 is located between the coil conductor 22 and a different coil conductor 22.

Each of the coil conductors 21 to 24, the lead conductors 13 and 14, and the through-hole conductors 17 includes a conductive material (for example, Ag or Pd), for example. Each of the coil conductors 21 to 24, the lead conductors 13 and 14, and the through-hole conductors 17 is configured as a sintered body of conductive paste including conductive metal powder (for example, Ag powder or Pd powder).

Figure 4:
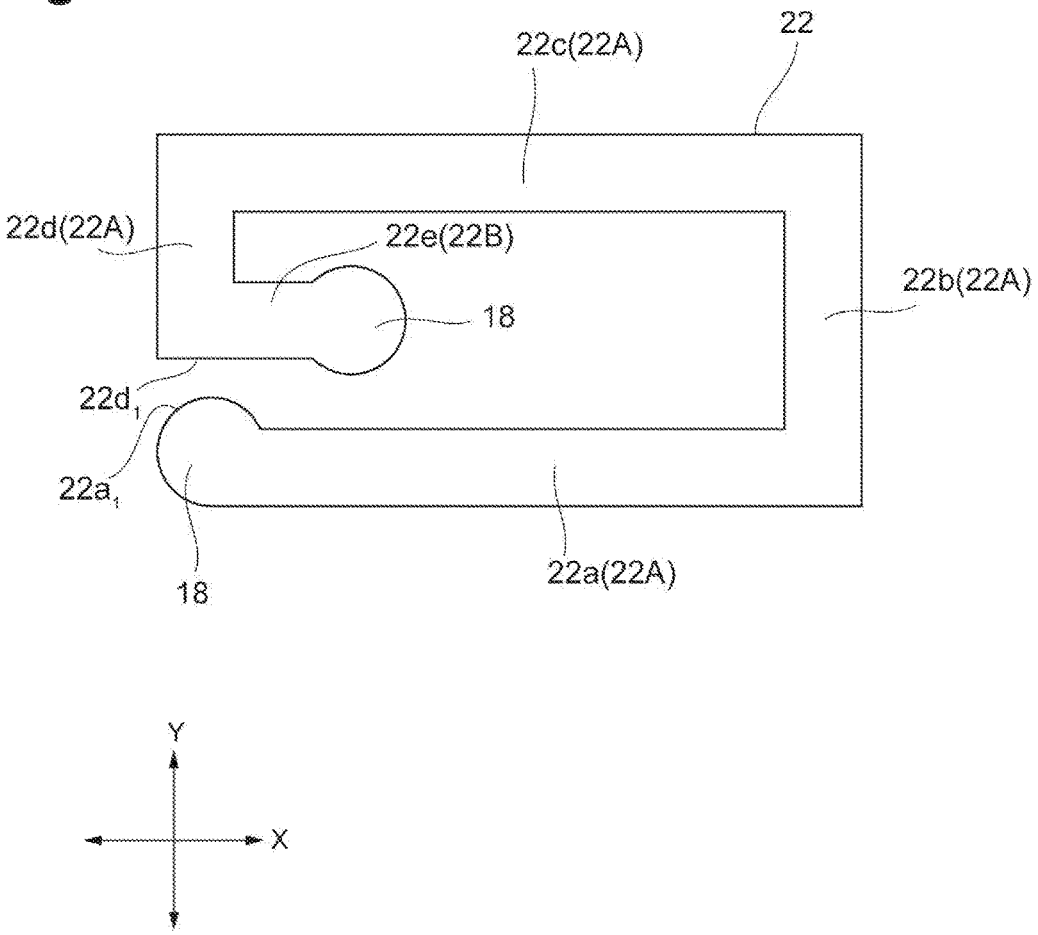
FIG. 4 is a plan view illustrating a coil conductor illustrated in FIG. 2.
Figure 5:
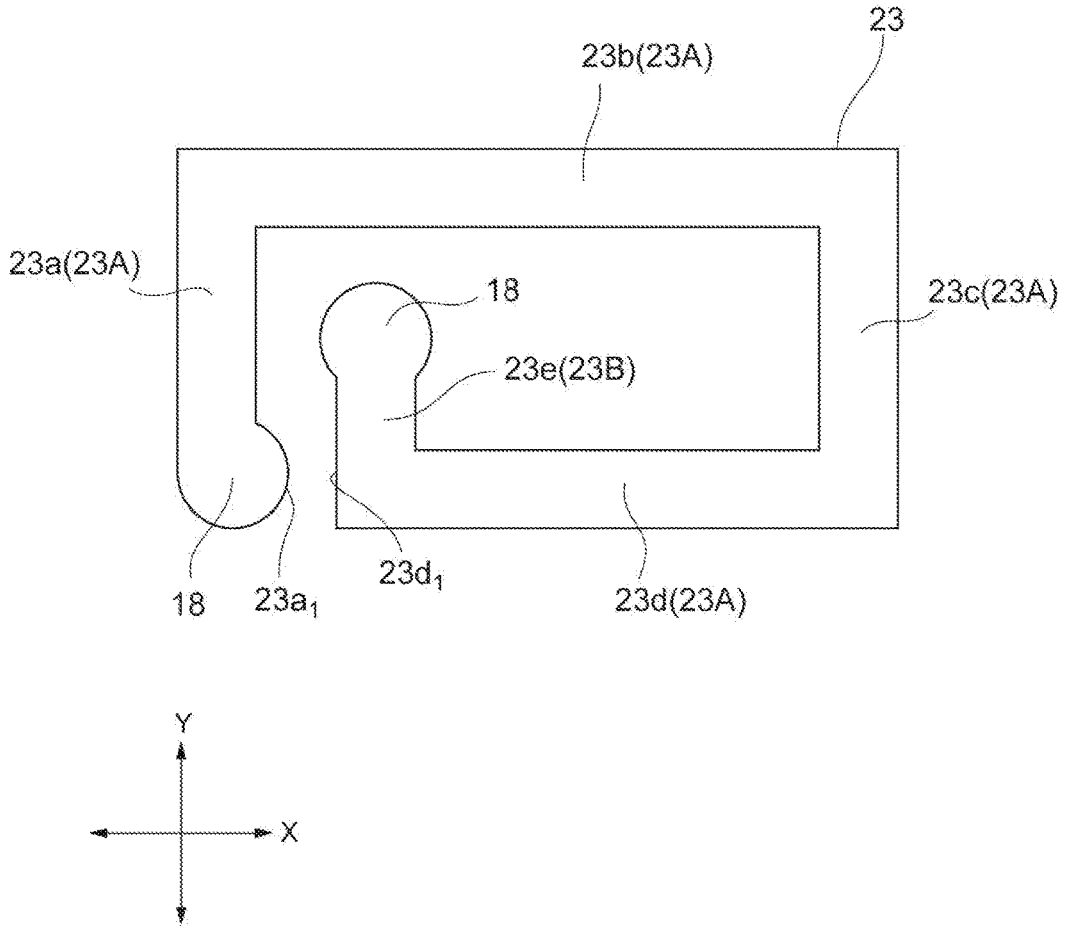
FIG. 5 is a plan view illustrating a coil conductor illustrated in FIG. 2.

As illustrated in FIGS. 3 to 5, each of the coil conductors 21 to 23 (a plurality of internal conductors) has an approximately annular shape. As illustrated in FIG. 6, the coil conductor 24 has an approximately U shape. Hereinafter, shapes of the individual coil conductors 21 to 24 will be described.

As illustrated in FIG. 3, the coil conductor 21 (first internal conductor) has a shape in which a conductor is wound once approximately in a rectangular shape. The coil conductor 21 includes an annular portion 21A and an extension portion 21B. The annular portion 21A includes one end portion and another end portion. An external shape of the annular portion 21A is an approximately rectangular shape. The annular portion 21A includes conductor portions 21*a*, 21*b*, 21*c*, and 21*d*. The conductor portions 21*a*, 21*b*, 21*c*, and 21*d* are located to correspond to the four surfaces (the end surfaces 2*a* and 2*b* and the side surfaces 2*e* and 2*f*) of the element body 2. The extension portion 21B extends along the one end portion of the annular portion 21A, from the other end portion of the annular portion 21A. The extension portion 21B is separated from the one end portion of the annular portion 21A.

The conductor portion 21*a* is the one end portion of the annular portion 21A. The conductor portion 21*a* extends along a direction (that is, the Y direction in the drawings) in which the pair of side surfaces 2*e* and 2*f* opposes each other. The conductor portion 21*a* includes the connection portion E1 to which the lead conductor 13 is connected. The conductor portion 21*b* is connected to a side opposite to the connection portion E1 in the conductor portion 21*a*. The conductor portion 21*b* extends along a direction (that is, the X direction in the drawings) in which the pair of end surfaces 2*a* and 2*b* opposes each other. The conductor portion 21*b* connects the conductor portion 21*a* and the conductor portion 21*c*.

The conductor portion 21*c* extends along the direction (that is, the Y direction in the drawings) in which the pair of side surfaces 2*e* and 2*f* opposes each other. The conductor portion 21*c* is separated from the conductor portion 21*a* in the X direction. A length of the conductor portion 21*c* in the Y direction is approximately equal to a length of the conductor portion 21*a* in the Y direction. The conductor portion 21*c* connects the conductor portion 21*b* and the conductor portion 21*d*.

The conductor portion 21*d* is the other end portion of the annular portion 21A. The conductor portion 21*d* extends along the direction (that is, the X direction in the drawings) in which the pair of end surfaces 2*a* and 2*b* opposes each other. The conductor portion 21*d* is separated from the conductor portion 21*b* in the Y direction. A length of the conductor portion 21*d* in the X direction is shorter than a length of the conductor portion 21*b* in the X direction. The conductor portion 21*d* connects the conductor portion 21*c* and the conductor portion 21*e*.

The conductor portion 21*e* extends from the conductor portion 21*d* along the conductor portion 21*a*. The conductor portion 21*e* extends along the direction (that is, the Y direction in the drawings) in which the pair of side surfaces 2*e* and 2*f* opposes each other. The conductor portion 21*e* is located between the conductor portion 21*a* and the conductor portion 21*c* in the X direction. That is, the conductor portion 21*e* is located closer to an inner side of the element body 2 than the conductor portions 21*a* and 21*c*. The conductor portion 21*e* is separated from the individual conductor portions 21*a* and 21*c* in the X direction. A length of the conductor portion 21*e* in the Y direction is shorter than the length of the conductor portion 21*a* in the Y direction. The conductor portion 21*e* includes the connection portion 18 to which the through-hole conductor 17 is connected.

The conductor portion 21*a* (the one end portion of the annular portion 21A) and the conductor portion 21*d* (the other end portion of the annular portion 21A) are separated from each other in the X direction. An edge $\mathbf{21}a_1$ of the conductor portion 21*a* and an edge $\mathbf{21}d_1$ of the conductor portion 21*d* oppose each other in the X direction. The conductor portion 21*a* and the conductor portion 21*d* include the edges $\mathbf{21}a_1$ and $\mathbf{21}d_1$ separated from each other in the X direction and opposing each other in the X direction, respectively.

As illustrated in FIG. 4, the coil conductor 22 (second internal conductor) has a shape in which a conductor is wound once approximately in a rectangular shape. The coil conductor 22 includes an annular portion 22A and an extension portion 22B. The annular portion 22A includes one end portion and another end portion. An external shape of the annular portion 22A is an approximately rectangular shape. The annular portion 22A includes conductor portions 22*a*, 22*b*, 22*c*, and 22*d*. The conductor portions 22*a*, 22*b*, 22*c*, and 22*d* are located to correspond to the four surfaces (the end surfaces 2*a* and 2*b* and the side surfaces 2*e* and 2*f*) of the element body 2. The extension portion 22B extends along the one end portion of the annular portion 22A, from the other end portion of the annular portion 22A. The extension portion 22B is separated from the one end portion of the annular portion 22A.

The conductor portion 22*a* is the one end portion of the annular portion 22A. The conductor portion 22*a* extends along the direction (that is, the X direction in the drawings) in which the pair of end surfaces 2*a* and 2*b* opposes each other. The conductor portion 22*a* includes the connection portion 18 to which the through-hole conductor 17 is connected. The conductor portion 22*b* is connected to a side opposite to the connection portion 18 in the conductor portion 22*a*. The conductor portion 22*b* extends along the direction (that is, the Y direction in the drawings) in which the pair of side surfaces 2*e* and 2*f* opposes each other. The conductor portion 22*b* connects the conductor portion 22*a* and the conductor portion 22*c*.

The conductor portion 22*c* extends along the direction (that is, the X direction in the drawings) in which the pair of end surfaces 2*a* and 2*b* opposes each other. The conductor portion 22*c* is separated from the conductor portion 22*a* in the Y direction. A length of the conductor portion 22*c* in the X direction is approximately equal to a length of the conductor portion 22*a* in the X direction. The conductor portion 22*c* connects the conductor portion 22*b* and the conductor portion 22*d*.

The conductor portion 22*d* is the other end portion of the annular portion 22A. The conductor portion 22*d* extends along the direction (that is, the Y direction in the drawings) in which the pair of side surfaces 2*e* and 2*f* opposes each other. The conductor portion 22*d* is separated from the conductor portion 22*b* in the X direction. A length of the conductor portion 22*d* in the Y direction is shorter than the length of the conductor portion 22*b* in the Y direction. The conductor portion 22*d* connects the conductor portion 22*c* and the conductor portion 22*e*.

The conductor portion 22*e* extends from the conductor portion 22*d* along the conductor portion 22*a*. The conductor portion 22*e* extends along the direction (that is, the X direction in the drawings) in which the pair of end surfaces 2*a* and 2*b* opposes each other. The conductor portion 22*e* is located between the conductor portion 22*a* and the conductor portion 22*c* in the Y direction. That is, the conductor portion 22*e* is located closer to the inner side of the element body 2 than the conductor portions 22*a* and 22*c*. The conductor portion 22*e* is separated from the individual conductor portions 22*a* and 22*c* in the Y direction. A length of the conductor portion 22*e* in the X direction is shorter than the length of the conductor portion 22*a* in the X direction. The conductor portion 22*e* includes the connection portion 18 to which the through-hole conductor 17 is connected.

The conductor portion 22*a* (the one end portion of the annular portion 22A) and the conductor portion 22*d* (the other end portion of the annular portion 22A) are separated from each other in the Y direction. An edge $\mathbf{22}a_1$ of the conductor portion 22*a* and an edge $\mathbf{22}d_1$ of the conductor portion 22*d* oppose each other in the Y direction. The conductor portion 22*a* and the conductor portion 22*d* include the edges $22a_1$ and $22d_1$ separated from each other in the Y direction and opposing each other in the Y direction, respectively.

As illustrated in FIG. 5, the coil conductor 23 (first internal conductor) has a shape in which a conductor is wound once approximately in a rectangular shape. The coil conductor 23 includes an annular portion 23A and an extension portion 23B. The annular portion 23A includes one end portion and another end portion. An external shape of the annular portion 23A is an approximately rectangular shape. The annular portion 23A includes conductor portions 23*a*, 23*b*, 23*c*, and 23*d*. The conductor portions 23*a*, 23*b*, 23*c*, and 23*d* are located to correspond to the four surfaces (the end surfaces 2*a* and 2*b* and the side surfaces 2*e* and 2*f*) of the element body 2. The extension portion 23B extends along the one end portion of the annular portion 23A, from the other end portion of the annular portion 23A. The extension portion 23B is separated from the one end portion of the annular portion 23A.

The conductor portion 23*a* is the one end portion of the annular portion 23A. The conductor portion 23*a* extends along a direction (that is, the Y direction in the drawings) in which the pair of side surfaces 2*e* and 2*f* opposes each other. The conductor portion 23*a* includes the connection portion 18 to which the through-hole conductor 17 is connected. The conductor portion 23*b* is connected to a side opposite to the connection portion 18 in the conductor portion 23*a*. The conductor portion 23*b* extends along the direction (that is, the X direction in the drawings) in which the pair of end surfaces 2*a* and 2*b* opposes each other. The conductor portion 23*b* connects the conductor portion 23*a* and the conductor portion 23*c*.

The conductor portion 23*c* extends along the direction (that is, the Y direction in the drawings) in which the pair of side surfaces 2*e* and 2*f* opposes each other. The conductor portion 23*c* is separated from the conductor portion 23*a* in the X direction. A length of the conductor portion 23*c* in the Y direction is approximately equal to a length of the conductor portion 23*a* in the Y direction. The conductor portion 23*c* connects the conductor portion 23*b* and the conductor portion 23*d*.

The conductor portion 23*d* is the other end portion of the annular portion 23A. The conductor portion 23*d* extends along the direction (that is, the X direction in the drawings) in which the pair of end surfaces 2*a* and 2*b* opposes each other. The conductor portion 23*d* is separated from the conductor portion 23*b* in the Y direction. A length of the conductor portion 23*d* in the X direction is shorter than a length of the conductor portion 23*b* in the X direction. The conductor portion 23*d* connects the conductor portion 23*c* and the conductor portion 23*e*.

The conductor portion 23*e* extends from the conductor portion 23*d* along the conductor portion 23*a*. The conductor portion 23*e* extends along the direction (that is, the Y direction in the drawings) in which the pair of side surfaces 2*e* and 2*f* opposes each other. The conductor portion 23*e* is located between the conductor portion 23*a* and the conductor portion 23*c* in the X direction. That is, the conductor portion 23*e* is located closer to the inner side of the element body 2 than the conductor portions 23*a* and 23*c*. The conductor portion 23*e* is separated from the individual conductor portions 23*a* and 23*c* in the X direction. A length of the conductor portion 23*e* in the Y direction is shorter than the length of the conductor portion 23*a* in the Y direction. The conductor portion 23*e* includes the connection portion 18 to which the through-hole conductor 17 is connected.

The conductor portion 23*a* (the one end portion of the annular portion 23A) and the conductor portion 23*d* (the other end portion of the annular portion 23A) are separated from each other in the X direction. An edge $23a_1$ of the conductor portion 23*a* and an edge $23d_1$ of the conductor portion 23*d* oppose each other in the X direction. The conductor portion 23*a* and the conductor portion 23*d* include the edges $23a_1$ and $23d_1$ separated from each other in the X direction and opposing each other in the X direction, respectively.

As illustrated in FIG. 6, the coil conductor 24 has a shape in which a conductor is wound in an approximately U shape. The coil conductor 24 includes conductor portions 24*a*, 24*b*, and 24*c*. The conductor portions 24*a*, 24*b*, and 24*c* are located to correspond to the three surfaces (the end surfaces 2*a* and 2*b* and the side surface 2*e*) of the element body 2.

The conductor portion 24*a* extends along the direction (that is, the Y direction in the drawings) in which the pair of side surfaces 2*e* and 2*f* opposes each other. The conductor portion 24*a* includes the connection portion 18 to which the through-hole conductor 17 is connected. The conductor portion 24*b* is connected to a side opposite to the connection portion 18 in the conductor portion 24*a*. The conductor portion 24*b* extends along the direction (that is, the X direction in the drawings) in which the pair of end surfaces 2*a* and 2*b* opposes each other. The conductor portion 24*b* connects the conductor portion 24*a* and the conductor portion 24*c*.

The conductor portion 24*c* extends along the direction (that is, the Y direction in the drawings) in which the pair of side surfaces 2*e* and 2*f* opposes each other. The conductor portion 24*c* is separated from the conductor portion 24*a* in the X direction. A length of the conductor portion 24*c* in the Y direction is approximately equal to a length of the conductor portion 24*a* in the Y direction. The conductor portion 24*c* includes the connection portion E2 to which the lead conductor 14 is connected.

Referring to FIG. 2 again, the magnetic gap layer 30 is disposed between the coil conductor 22 and the coil conductor 23. The magnetic gap layer 30 is located at approximately a center in the element body 2 in the Z direction (refer to FIGS. 7 and 8). The magnetic gap layer 30 has an approximately rectangular shape when viewed from the Z direction. The magnetic gap layer 30 extends to entirely cover a lamination surface along the Z direction, that is, a cross-section (surface extending in the X direction and the Y direction) crossing an axial direction of the coil 20 in the element body 2. A through-hole is formed in the magnetic gap layer 30. The through-hole conductor 17 to connect the coil conductor 22 and the coil conductor 23 located at both sides of the magnetic gap layer 30 in the Z direction is disposed in the through-hole.

The low-permeability layers 31 are disposed between the coil conductor 21 and the coil conductor 22 adjacent to each other in the Z direction, between the coil conductor 22 and the coil conductor 23 adjacent to each other in the Z direction, and between the coil conductor 22 and the coil conductor 24 adjacent to each other in the Z direction. Each of the low-permeability layers 31 has a frame shape, for example.

The low-permeability layer 31 located between the coil conductor 21 and the coil conductor 22 contacts a conductor portion of the coil conductor 21 overlapping the coil conductor 22 and a conductor portion of the coil conductor 22 overlapping the coil conductor 21, when viewed from the Z direction. That is, the low-permeability layer 31 located between the coil conductor 21 and the coil conductor 22 is disposed along the conductor portion of the coil conductor 21 and the conductor portion of the coil conductor 22. The low-permeability layer 31 located between the coil conductor 21 and the coil conductor 22 contacts a conductor portion of the coil conductor 21 not overlapping the coil conductor 22 and a conductor portion of the coil conductor 22 not overlapping the coil conductor 21, when viewed from the Z direction. That is, the low-permeability layer 31 also overlaps a region between the conductor portion 21*a* and the conductor portion 21*d* and a region between the conductor portion 22*a* and the conductor portion 22*d*, when viewed from the Z direction.

The low-permeability layer 31 located between the coil conductor 22 and the coil conductor 23 contacts a conductor portion of the coil conductor 22 overlapping the coil conductor 23 and a conductor portion of the coil conductor 23 overlapping the coil conductor 22, when viewed from the Z direction. That is, the low-permeability layer 31 located between the coil conductor 22 and the coil conductor 23 is disposed along the conductor portion of the coil conductor 22 and the conductor portion of the coil conductor 23. The low-permeability layer 31 located between the coil conductor 22 and the coil conductor 23 contacts a conductor portion of the coil conductor 22 not overlapping the coil conductor 23 and a conductor portion of the coil conductor 23 not overlapping the coil conductor 22, when viewed from the Z direction. That is, the low-permeability layer 31 also overlaps a region between the conductor portion 22*a* and the conductor portion 22*d* and a region between the conductor portion 23*a* and the conductor portion 23*d*, when viewed from the Z direction.

The low-permeability layer 31 located between the coil conductor 22 and the coil conductor 24 contacts a conductor portion of the coil conductor 22 overlapping the coil conductor 24 and a conductor portion of the coil conductor 24 overlapping the coil conductor 22, when viewed from the Z direction. That is, the low-permeability layer 31 located between the coil conductor 22 and the coil conductor 24 is disposed along the conductor portion of the coil conductor 22 and the conductor portion of the coil conductor 24. The low-permeability layer 31 located between the coil conductor 22 and the coil conductor 24 contacts a conductor portion of the coil conductor 22 not overlapping the coil conductor 24 and a conductor portion of the coil conductor 24 not overlapping the coil conductor 22, when viewed from the Z direction. That is, the low-permeability layer 31 also overlaps a region between the conductor portion 22*a* and the conductor portion 22*d* and a region between the conductor portion 24*a* and the conductor portion 24*c*, when viewed from the Z direction.

Each of the magnetic gap layer 30 and the low-permeability layers 31 has permeability lower than permeability of the element body 2. The magnetic gap layer 30 and the low-permeability layers 31 include a weakly magnetic material having permeability lower than permeability of the magnetic portion 11 or a non-magnetic material not having magnetism, for example. In this embodiment, the magnetic gap layer 30 and the low-permeability layers 31 are configured as sintered bodies of non-magnetic paste including powder of a non-magnetic material (a Cu—Zn based ferrite material).

Because the magnetic gap layer 30 has non-magnetism, the magnetic gap layer 30 blocks magnetic flux generated around the entire coil 20. Therefore, generation of magnetic saturation is suppressed around the entire coil 20. Because the individual low-permeability layers 31 have non-magnetism and contact the individual coil conductors 21 to 24 adjacent to the low-permeability layers 31 in the Z direction, the individual low-permeability layers 31 block the magnetic flux generated around the individual coil conductors 21 to 24. Therefore, the magnetic flux is hard to flow around the individual coil conductors 21 to 24. Generation of local magnetic saturation is suppressed around the individual coil conductors 21 to 24. As a result, generation of the magnetic saturation is suppressed in the multilayer coil component 1 and a direct-current superposition characteristic of the multilayer coil component 1 is improved.

As illustrated in FIG. 7, the conductor portion 21*a* of the coil conductor 21 includes a first portion 21*g* and a second portion 21*f*. The first portion 21*g* overlaps the individual edges $\mathbf{22}a_1$ and $\mathbf{22}d_1$ (refer to FIG. 4) of the coil conductor 22 adjacent to the coil conductor 21 in the Z direction, when viewed from the Z direction. The second portion 21*f* overlaps a region between the edge $\mathbf{22}a_1$ and the edge $\mathbf{22}d_1$, when viewed from the Z direction.

The second portion 21*f* includes one surface and another surface that oppose each other in the first direction (Z direction). The one surface of the second portion 21*f* is recessed and the other surface of the second portion 21*f* is flat. The second portion 21*f* is recessed at a side opposite to the region between the edge $\mathbf{22}a_1$ and the edge $\mathbf{22}d_1$, as compared with the first portion 21*g*, A thickness La of the second portion 21*f* in the Z direction is smaller than a thickness Lb of the first portion 21*g* in the Z direction. The thickness La may be an average thickness of the second portion 21*f* and may be a thickness at a predetermined position of the second portion 21*f*. The second portion 21*f* is thinner than the first portion 21*g* in the Z direction.

An interval between the edges $\mathbf{22}a_1$ and $\mathbf{22}d_1$ is a distance L2. The coil conductor 22 does not exist in each region between the edges $\mathbf{22}a_1$ and $\mathbf{22}d_1$. The second portion 21*f* of the coil conductor 21 and the second portion 23*f* of the coil conductor 23 are adjacent to each other with each region between the edges $\mathbf{22}a_1$ and $\mathbf{22}d_1$ therebetween. A region S2 is formed between the second portion 21*f* and the second portion 23*f* adjacent to each other in the Z direction. The region S2 is a region that is interposed by the second portion 21*f* and the second portion 23*f*. The low-permeability layer 31 is interposed between the second portion 21*f* and the second portion 23*f* adjacent to each other in the Z direction. The region S2 includes not only the magnetic portion 11 of the element body 2 but also the low-permeability layer 31. The second portion 21*f* is more recessed than the first portion 21*g* and is thinner than the first portion 21*g* in the Z direction. For this reason, the region S2 is widened in the Z direction.

The conductor portion 23*a* of the coil conductor 23 includes a first portion 23*g* and a second portion 23*f*. The first portion 23*g* overlaps the individual edges $\mathbf{22}a_1$ and $\mathbf{22}d_1$ (refer to FIG. 4) of the coil conductor 22 adjacent to the coil conductor 23 in the Z direction, when viewed from the Z direction. The second portion 23*f* overlaps the region between the edge $\mathbf{22}a_1$ and the edge $\mathbf{22}d_1$, when viewed from the Z direction.

The second portion 23*f* includes one surface and another surface that oppose each other in the first direction (Z direction). The one surface of the second portion 23*f* is recessed and the other surface of the second portion 23*f* is flat. The second portion 23*f* is recessed at a side opposite to the region between the edge $\mathbf{22}a_1$ and the edge $\mathbf{22}d_1$, as compared with the first portion 23*g*. A thickness La of the second portion 23*f* in the Z direction is smaller than a thickness Lb of the first portion 23*g* in the Z direction. The thickness La may be an average thickness of the second portion 23*f* and may be a thickness at a predetermined position of the second portion 23*f*. The second portion 23*f* is thinner than the first portion 23*g* in the Z direction.

An interval between the edges $\mathbf{22}a_1$ and $\mathbf{22}d_1$ is a distance L2. The coil conductor 22 does not exist in each region between the edges $\mathbf{22}a_1$ and $\mathbf{22}d_1$. The second portions 23*f* of the coil conductors 23 are adjacent to each other with each region between the edges $\mathbf{22}a_1$ and $\mathbf{22}d_1$ therebetween. The region S2 is formed between the second portions 23*f* adjacent to each other in the Z direction. The region S2 is a region that is interposed by the second portions 23*f* adjacent to each other in the Z direction. The low-permeability layer 31 is interposed between the second portions 23*f* adjacent to each other in the Z direction. The region S2 includes not only the magnetic portion 11 of the element body 2 but also the low-permeability layer 31. The second portion 23*f* is more recessed than the first portion 23*g* and is thinner than the first portion 23*g* in the Z direction. For this reason, the region S2 is widened in the Z direction.

Figure 9:
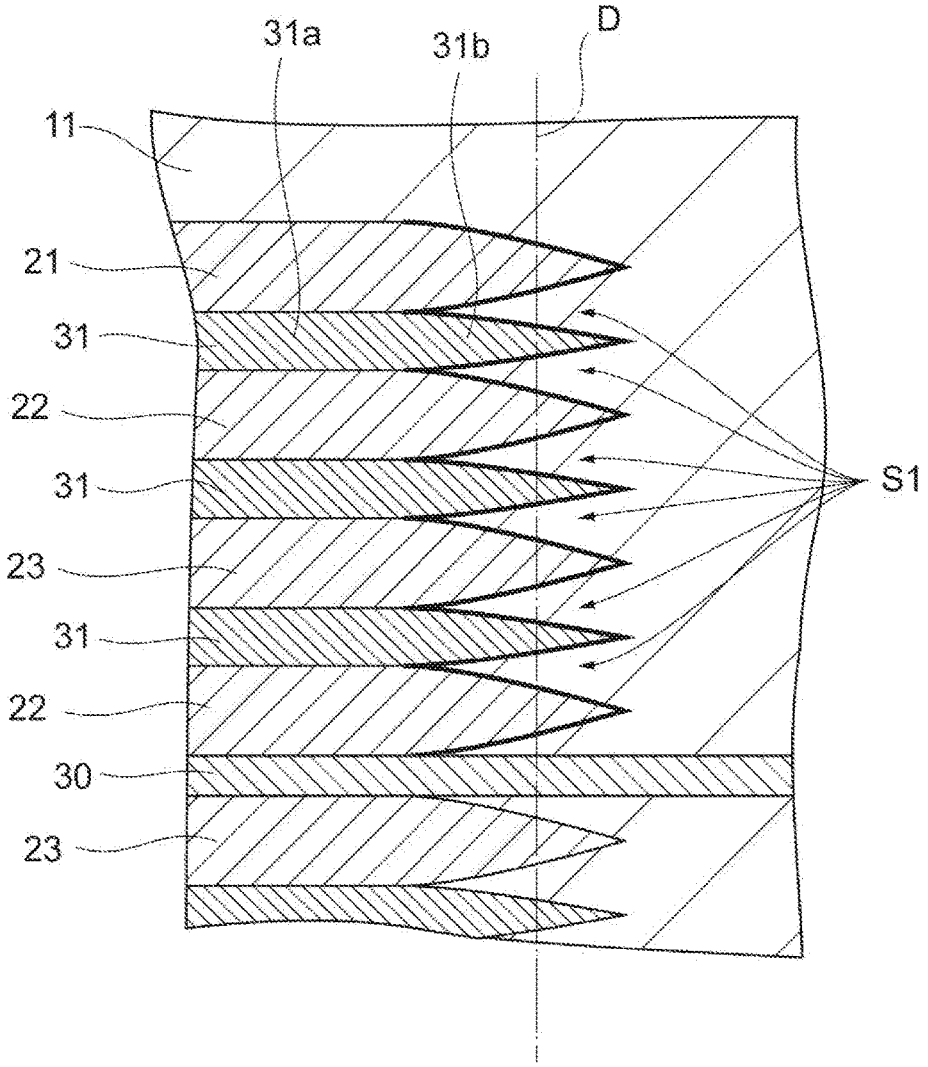
FIG. 9 is a cross-sectional view illustrating a part of the element body illustrated in FIG. 7.

FIG. 9 is a cross-sectional view illustrating a part of the element body illustrated in FIG. 7. A region including boundaries between the coil conductors 21 to 23 and low-permeability layers 31 and the element body 2 is illustrated in FIG. 9. As illustrated in FIG. 9, the low-permeability layer 31 includes a contact portion 31*a* (fifth portion) and a separation portion 31*b* (sixth portion). The contact portion 31*a* contacts the coil conductors 21 and 23 and the coil conductor 22. The separation portion 31*b* is separated from the coil conductors 21 and 23 and the coil conductor 22 in the Z direction. The coil conductors 21 and 23 and the coil conductor 22 are adjacent to each other in the Z direction.

The element body 2 includes element body regions S1. The element body regions S1 are interposed between the separation portions 31*b* of the low-permeability layers 31 and the coil conductors 21 to 23 adjacent to the corresponding separation portions 31*b* in the Z direction. The element body regions S1 are located between the separation portion 31*b* and the coil conductor 21, between the separation portion 31*b* and the coil conductor 22, and between the separation portion 31*b* and the coil conductor 23.

In a region illustrated in FIG. 9, the coil conductors 21 to 23, the element body regions S1, and the low-permeability layers 31 are arranged on a virtual axis D along the Z direction, in order of the coil conductor 21, the element body region S1, the low-permeability layer 31, the element body region S1, the coil conductor 22, the element body region S1, the low-permeability layer 31, the element body region S1, the coil conductor 23, the element body region S1, the low-permeability layer 31, the element body region S1, and the coil conductor 22. The element body regions S1 are interposed between the coil conductors 21 to 23 and the low-permeability layers 31 adjacent to each other in the Z direction. The boundaries between the coil conductors 21 to 23 and low-permeability layers 31 and the element body 2 are not formed along the Z direction and include surfaces crossing the Z direction.

Although not illustrated in FIG. 9, in the first embodiment, the element body region S1 is also located between the separation portion 31*b* and the coil conductor 24. The element body region S1 is also interposed between the coil conductor 24 and the low-permeability layer 31 adjacent to each other in the Z direction. Also, boundaries between the coil conductors 23 and low-permeability layers 31 and the element body 2 are not formed along the Z direction and include surfaces crossing the Z direction.

Next, a process for manufacturing the multilayer coil component 1 will be described. The multilayer coil component 1 is manufactured as follows, First, a laminate body is obtained by sequentially laminating a magnetic paste pattern to configure the magnetic portion 11, a conductive past pattern to configure the coil conductors 21 to 24, the lead conductors 13 and 14, and the through-hole conductors 17, and a non-magnetic paste pattern to configure the magnetic gap layer 30 and the low-permeability layers 31 by a printing method.

The magnetic paste pattern is formed by applying magnetic paste and drying the magnetic paste. The magnetic paste is manufactured by mixing powder of the magnetic material and an organic solvent and an organic binder. The conductive paste pattern is formed by applying conductive paste and drying the conductive paste. The conductive paste is manufactured by mixing the conductive metal powder and the organic solvent and the organic binder. The non-magnetic paste pattern is formed by applying non-magnetic paste and drying the non-magnetic paste. The non-magnetic paste is manufactured by mixing powder of the non-magnetic material or the weakly magnetic material and the organic solvent and the organic binder.

Next, a plurality of green chips are obtained by cutting the laminate body. The green chip has a size corresponding to a size of the element body 2. Next, barrel polishing is performed on the obtained green chip. As a result, the green chip in which a corner portion or a ridge portion is rounded is obtained. Next, the green chip on which the barrel polishing has been performed is fired under a predetermined condition. As a result, the magnetic portion 11 is configured as a sintered body of the magnetic paste pattern and the element body 2 is obtained. The coil conductors 21 to 24, the lead conductors 13 and 14, and the through-hole conductors 17 are configured as sintered bodies of the conductive paste pattern. The magnetic gap layer 30 and the low-permeability layers 31 are configured as sintered bodies of the non-magnetic paste pattern. That is, the element body 2 includes the coil conductors 21 to 24, the through-hole conductors 17, the magnetic gap layer 30, and the low-permeability layers 31.

Next, conductive paste for the external electrodes 4 and 5 is applied to an external surface of the element body 2 and the applied conductive paste is thermally treated under a predetermined condition. As a result, the external electrodes 4 and 5 are formed in the element body 2. Then, plating is performed on surfaces of the external electrodes 4 and 5. In this way, the multilayer coil component 1 is obtained.

In the multilayer coil component 1 according to the first embodiment, the first portions 21*g* and 23*g* of the coil conductors 21 and 23 overlap the edges $\mathbf{22}a_1$ and $\mathbf{22}d_1$ of the coil conductor 22 adjacent to the coil conductors 21 and 23 in the Z direction. The second portions 21*f* and 23*f* of the coil conductors 21 and 23 overlap the region between the edges $\mathbf{22}a_1$ and $\mathbf{22}d_1$ of the coil conductor 22 adjacent to the coil conductors 21 and 23 in the Z direction. In the region between the edges $\mathbf{22}a_1$ and $\mathbf{22}d_1$, the second portions 21*f* and 23*f* are adjacent to each other in the Z direction with the region between the edges $\mathbf{22}a_1$ and $\mathbf{22}d_1$ therebetween. Between the edges $\mathbf{22}a_1$ and $\mathbf{22}d_1$ of the coil conductor 23, the region S2 is formed between the second portions 21*f* and 23*f* adjacent to each other in the Z direction, as described above. The second portions 21*f* and 23*f* are recessed at the side opposite to the region between the edges $\mathbf{22}a_1$ and $\mathbf{22}d_1$, as compared with the first portions 21*g* and 23*g*. For this reason, the region S2 is wide in the Z direction and a volume of the region S2 is large. As a result, because the strength in the region S2 is improved, generation of a crack is suppressed in the region between the edges $\mathbf{22}a_1$ and $\mathbf{22}d_1$.

In the multilayer coil component 1 according to the first embodiment, because the second portions 21*f* and 23*f* of the coil conductors 21 and 23 are thinner than the first portions 21*g* and 23*g* of the coil conductors 21 and 23 in the Z direction, the region S2 is surely widened in the Z direction and the volume of the region S2 is surely increased. As a result, because the strength in the region S2 is surely improved, generation of the crack is surely suppressed in the region between the edges $\mathbf{22}a_1$ and $\mathbf{22}d_1$.

In the multilayer coil component 1 according to the first embodiment, the coil conductors 21 to 23 include the conductor portions overlapping each other when viewed from the Z direction. The low-permeability layers 31 contact the conductor portions between the coil conductors 21 to 23 adjacent to each other. For this reason, the magnetic flux generated around the individual coil conductors 21 to 23 in the element body 2 is blocked by the low-permeability layers 31. As a result, generation of the magnetic saturation is suppressed and the direct-current superposition characteristic of the multilayer coil component 1 is improved.

The coil conductor 24 and the coil conductor 22 include the conductor portions overlapping each other when viewed from the Z direction. The low-permeability layer 31 is also disposed between the coil conductor 24 and the coil conductor 22 adjacent to each other and contacts the conductor portions of the coil conductor 24 and the coil conductor 22. For this reason, the magnetic flux generated around the coil conductor 24 and the coil conductor 22 in the element body 2 is also blocked by the low-permeability layers 31. As a result, generation of the magnetic saturation is further suppressed and the direct-current superposition characteristic of the multilayer coil component 1 is further improved.

In the multilayer coil component 1 according to the first embodiment, the low-permeability layers 31 include the separation portions 31*b*. The element body regions S1 are interposed between the separation portions 31*b* and the coil conductors 21 to 23. Therefore, the boundaries between the coil conductors 21 to 23 and low-permeability layers 31 and the element body 2 are not formed along the Z direction and include the surfaces crossing the Z direction. For this reason, the boundaries between the coil conductors 21 to 23 and low-permeability layers 31 and the element body 2 function as resistances against a shearing stress along the Z direction and the shearing stress along the Z direction is dispersed in a direction crossing the Z direction. As a result, even when the shearing stress along the Z direction is generated, a crack is hard to be generated in the element body 2. By the above configuration, in the multilayer coil component 1, the direct-current superposition characteristic is improved and generation of the crack is further suppressed.

The element body regions S1 are also interposed between the separation portions 31*b* and the coil conductors 24. Therefore, the boundaries between the coil conductors 24 and low-permeability layers 31 and the element body 2 are not formed along the Z direction and include the surfaces crossing the Z direction. For this reason, the boundaries between the coil conductors 24 and low-permeability layers 31 and the element body 2 function as resistances against the shearing stress along the Z direction and the shearing stress along the Z direction is dispersed in a direction crossing the Z direction. As a result, the generation of the crack is further suppressed.

Second Embodiment

Figure 10:
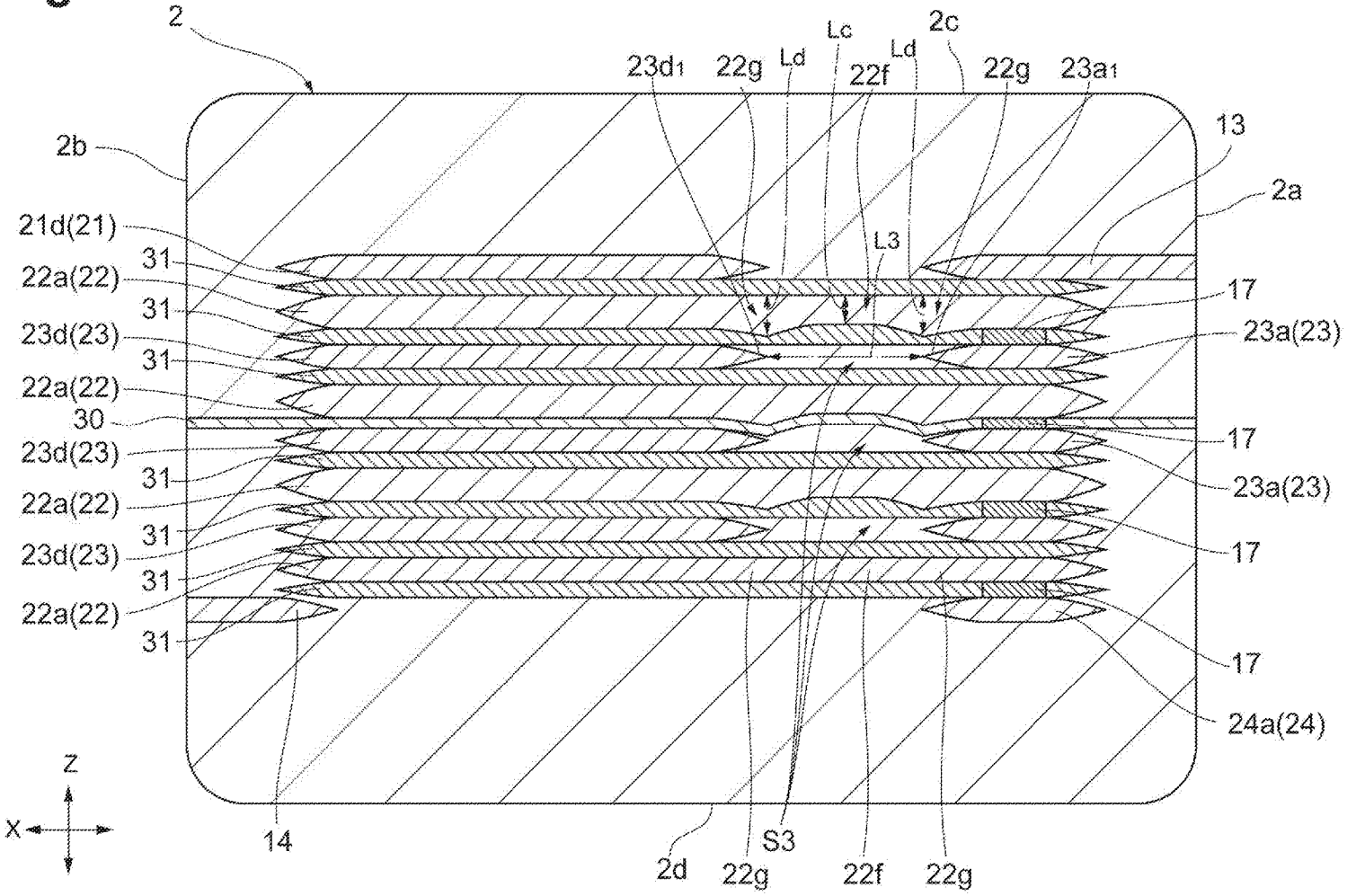
FIG. 10 is a cross-sectional view of an element body of a multilayer coil component according to a second embodiment.

Next, a multilayer coil component according to a second embodiment will be described with reference to FIG. 10. FIG. 10 is a cross-sectional view of an element body of the multilayer coil component according to the second embodiment. A cross-sectional configuration illustrated in FIG. 10 corresponds to the cross-sectional configuration of the element body taken along the line X-X of FIG. 1.

Although not illustrated in the drawings, the multilayer coil component according to the second embodiment includes an element body 2, a pair of external electrodes 4 and 5 (refer to FIG. 1), a plurality of coil conductors 21 to 24 (refer to FIGS. 2 to 6), a plurality of lead conductors 13 and 14 (refer to FIG. 2), one magnetic gap layer 30 (refer to FIG. 2), and a plurality of low-permeability layers 31 (refer to FIG. 2), similar to the multilayer coil component 1 according to the first embodiment.

Similar to the first embodiment, the coil conductors 21 and 23 include first portions 21*g* and 23*g* and second portions 21*f* and 23*f*, respectively. The second portion 21*f* of the coil conductor 21 and the second portion 23*f* of the coil conductor 23 are adjacent to each other with each region between edges $\mathbf{22}a_1$ and $\mathbf{22}d_1$ therebetween, A region S2 is formed between the second portion 21*f* and the second portion 23*f* adjacent to each other in a Z direction (refer to FIG. 7). The region S2 is a region that is interposed by the second portion 21*f* and the second portion 23*f*.

Similar to the first embodiment, the low-permeability layer 31 includes a contact portion 31*a* and a separation portion 31*b* and the element body 2 includes a plurality of element body regions S1 (refer to FIG. 9). Boundaries between the coil conductors 21 to 24 and low-permeability layers 31 and the element body 2 are not formed along the Z direction and include surfaces crossing the Z direction.

As illustrated in FIG. 10, the multilayer coil component according to the second embodiment is different from the multilayer coil component 1 in that the coil conductor 22 includes a third portion 22*g* and a fourth portion 22*f*. The third portion 22*g* overlaps individual edges $\mathbf{23}a_1$ and $\mathbf{23}d_1$ (refer to FIG. 5) of the coil conductor 23 adjacent to the coil conductor 22 in the Z direction, when viewed from the Z direction. The fourth portion 22*f* overlaps a region between the edges $\mathbf{23}a_1$ and $\mathbf{23}d_1$, when viewed from the Z direction.

The fourth portion 22*f* includes one surface and another surface that oppose each other in a first direction (Z direction). The one surface of the fourth portion 22*f* is recessed and the other surface of the fourth portion 22*f* is flat. The fourth portion 22*f* is recessed at a side opposite to the region between the edge $\mathbf{23}a_1$ and the edge $\mathbf{23}d_1$, as compared with the third portion 22*g*. A thickness Lc of the fourth portion 22*f* in the Z direction is smaller than a thickness Ld of the third portion 22*g* in the Z direction. The thickness Lc may be an average thickness of the fourth portion 22*f* and may be a thickness at a predetermined position of the fourth portion 22*f*. The fourth portion 22*f* is thinner than the third portion 22*g* in the Z direction.

An interval between the edges $\mathbf{23}a_1$ and $\mathbf{23}d_1$ is a distance L3. The coil conductor 23 does not exist in the region between the edges $\mathbf{23}a_1$ and $\mathbf{23}d_1$. The fourth portions 22*f* of the coil conductors 22 are adjacent to each other with the region between the edges $\mathbf{23}a_1$ and $\mathbf{23}d_1$ therebetween. A region S3 is formed between the fourth portions 22*f* adjacent to each other in the Z direction. The region S3 is a region that is interposed by the fourth portions 22*f* adjacent to each other in the Z direction. The low-permeability layer 31 is interposed between the fourth portions 22*f* adjacent to each other in the Z direction. The region S3 includes not only a magnetic portion 11 of the element body 2 but also the low-permeability layer 31. The fourth portion 22*f* is more recessed than the third portion 22*g* and is thinner than the third portion 22$g$ in the Z direction. For this reason, the region S3 is widened in the Z direction.

Even in the multilayer coil component according to the second embodiment, similar to the first embodiment, because the region S2 is wide in the Z direction, generation of a crack is suppressed in the region between the edges 22$a_1$ and 22$d_1$.

According to the multilayer coil component according to the second embodiment, between the edges 23$a_1$ and 23$d_1$ of the coil conductor 23, the fourth portions 22$f$ of the coil conductors 22 are adjacent to each other in the Z direction with the region between the edges 23$a_1$ and 23$d_1$ therebetween. Between the edges 23$a_1$ and 23$d_1$ of the coil conductor 23, the region S3 is formed between the fourth portions 22$f$ adjacent to each other in the Z direction, as described above. The fourth portion 22$f$ of the coil conductor 22 is recessed at the side opposite to the region between the edges 23$a_1$ and 23$d_1$, as compared with the third portion 22$g$ of the coil conductor 22. For this reason, the region S3 is wide in the Z direction and a volume of the region S3 is large. As a result, because the strength in the region S3 is improved, generation of a crack is suppressed in the region between the edges 23$a_1$ and 23$d_1$.

According to the multilayer coil component according to this embodiment, because the fourth portion 22$f$ is thinner than the third portion 22$g$ in the Z direction, the region S3 is surely widened in the Z direction and the volume of the region S3 is surely increased. As a result, because the strength in the region S3 is surely improved, generation of the crack is surely suppressed in the region between the edges 23$a_1$ and 23$d_1$.

The various embodiments have been described. However, the present invention is not limited to the embodiments and various changes, modifications, and applications can be made without departing from the gist of the present invention.

A coil conductor not including the first portions 21$g$ and 23$g$ and the second portions 21$f$ and 23$f$ may be included in the plurality of coil conductors 21 to 23. At least one of the plurality of coil conductors 21 and 23 may satisfy a relation in which the thickness La of the second portions 21$f$ and 23$f$ is smaller than the thickness Lb of the first portions 21$g$ and 23$g$.

A coil conductor not including the third portion 22$g$ and the fourth portion 22$f$ may be included in the plurality of coil conductors 22. The coil conductor 22 may not satisfy a relation in which the thickness Lc of the fourth portion 22$f$ is smaller than the thickness Ld of the third portion 22$g$.

The number of coil conductors, the number of magnetic gap layers, and the number of low-permeability layers in the element body 2 are not limited to the embodiments. The plurality of internal conductors may include at least the two coil conductors 21 and 23 and the coil conductor 22 located between the two coil conductors 21 and 23. The number of magnetic gap layers 30 may be plural and the number of low-permeability layers 31 may be one.

The multilayer coil component may include only any one of the magnetic gap layer 30 and the low-permeability layer 31. The multilayer coil component may not include both the magnetic gap layer 30 and the low-permeability layer 31.

The low-permeability layer 31 may include the plurality of separation portions 31$b$ between the coil conductors 21 and 23 and the coil conductor 22. The boundary between one low-permeability layer 31 and the element body 2 may include a surface crossing the Z direction. In this case, the boundary between the one low-permeability layer 31 and the element body 2 functions as a resistance against the shearing stress along the Z direction and the shearing stress along the Z direction is dispersed in a direction crossing the Z direction. As a result, the strength against the shearing stress along the Z direction is increased and generation of the crack is further suppressed.

The low-permeability layer 31 may not include the separation portion 31$b$. The boundaries between the coil conductors 21 to 24 and low-permeability layers 31 and the element body 2 may not include the surfaces crossing the Z direction.

In the embodiments, the low-permeability layer 31 is configured by the non-magnetic material. However, the present invention is not limited thereto. For example, the low-permeability layer 31 may be configured by a weakly magnetic material having permeability lower than the permeability of the element body 2.

In the embodiments, the low-permeability layers 31 have the frame shape. However, the present invention is not limited thereto. For example, parts of the low-permeability layers 31 may be cut. The low-permeability layers 31 may not contact the conductor portions not overlapping each other in the coil conductors 21 to 24. The low-permeability layers 31 may not overlap the separation regions in the coil conductors 21 to 24, when viewed from the Z direction.

In the embodiments, the regions S2 and S3 include not only the magnetic portion 11 of the element body 2 but also the low-permeability layer 31. However, the low-permeability layer 31 may not be included in the regions S2 and S3.

What is claimed is:

1. A multilayer coil component comprising:

an element body that has magnetism; and a coil that includes a plurality of internal conductors disposed in the element body, each of the plurality of internal conductors including an annular portion with one end portion and another end portion and an extension portion extending along the one end portion from the other end portion and separated from the one end portion, an edge of the one end portion and an edge of the other end portion opposing each other, wherein the plurality of internal conductors include two first internal conductors and a second internal conductor located between the two first internal conductors in a first direction, the one end portion of at least one first internal conductor of the two first internal conductors includes a first portion overlapping the edges of the one end portion and the other end portion of the second internal conductor and a second portion overlapping a first region between the edges of the one end portion and the other end portion of the second internal conductor, when viewed from the first direction, and the second portion is recessed at a side opposite to the first region, as compared with the first portion.

2. The multilayer coil component according to claim 1, wherein a thickness of the second portion in the first direction is smaller than a thickness of the first portion in the first direction.

3. The multilayer coil component according to claim 1, wherein the plurality of internal conductors further includes another second internal conductor, the first internal conductor is located between the second internal conductor and the other second internal conductor in the first direction, the one end portion of at least one second internal conductor of the second internal conductor and the other second internal conductor includes a third portion overlapping the edges of the one end portion and the other end portion of the first internal conductor and a fourth portion overlapping a second region between the edges of the one end portion and the other end portion of the first internal conductor, when viewed from the first direction, and the fourth portion is recessed at a side opposite to the second region, as compared with the third portion.

4. The multilayer coil component according to claim 3, wherein a thickness of the fourth portion in the first direction is smaller than a thickness of the third portion in the first direction.

5. The multilayer coil component according to claim 1, further comprising:

a low-permeability layer that has permeability lower than permeability of the element body, wherein the plurality of internal conductors include conductor portions overlapping each other when viewed from the first direction, and the low-permeability layer contacts the conductor portions, between the internal conductors adjacent to each other in the first direction.

6. The multilayer coil component according to claim 5, wherein the low-permeability layer includes a fifth portion contacting the internal conductor adjacent to the low-permeability layer in the first direction and a sixth portion separated from the internal conductor adjacent to the low-permeability layer in the first direction, in the first direction, and the element body includes element body regions interposed between the sixth portion and the internal conductor.

* * * * *